US007364122B2

(12) United States Patent
Kovach et al.

(10) Patent No.: US 7,364,122 B2
(45) Date of Patent: Apr. 29, 2008

(54) CONTROL FOR OPERATING FEATURES OF A MODEL VEHICLE

(75) Inventors: Louis Kovach, Belleville, MI (US); James Rohde, Walled Lake, MI (US); Neil P. Young, Redwood City, CA (US)

(73) Assignee: Lionel L.L.C., Chesterfield, MI (US)

( * ) Notice: Subject to any disclaimer, the term of this patent is extended or adjusted under 35 U.S.C. 154(b) by 0 days.

(21) Appl. No.: 10/617,003

(22) Filed: Jul. 10, 2003

(65) Prior Publication Data

US 2004/0127293 A1 Jul. 1, 2004

Related U.S. Application Data

(60) Provisional application No. 60/394,550, filed on Jul. 10, 2002.

(51) Int. Cl.
*B61L 7/08* (2006.01)

(52) U.S. Cl. ..... 246/4; 246/167 R

(58) Field of Classification Search ..... 246/3, 246/4, 5, 167 R, 187 R, 187 A, 187 B; 104/300, 104/302, DIG. 1; 701/19
See application file for complete search history.

(56) References Cited

U.S. PATENT DOCUMENTS 4,914,431 A 4/1990 Severson et al.
5,184,048 A 2/1993 Severson et al.
5,251,856 A 10/1993 Young et al.
5,394,068 A 2/1995 Severson et al.
5,441,223 A 8/1995 Young et al.
5,749,547 A * 5/1998 Young et al. ..... 246/4
6,113,458 A 9/2000 Brown
6,320,346 B1 11/2001 Graf
6,441,570 B1 8/2002 Grubba
6,457,681 B1 10/2002 Wolf et al.

OTHER PUBLICATIONS

M.T.H. Electric Trains Z-4000 400-Watt Transformer Operating Instructions, http://www.mth-railking.com—printed Aug. 12, 2003.
Lionel Electric Trains Trainmaster Command: The Complete Guide to Command Control—published 1995 U.S.A.
Trainmeter Command Control and Conventional Power, http://www.lionel.com/products/catalogs/cat-2002-C-1/pgs.-98-99.htm—printed Jun. 17, 2002.

* cited by examiner

*Primary Examiner*—S. Joseph Morano
*Assistant Examiner*—Robert J. McCarry, Jr.
(74) *Attorney, Agent, or Firm*—O'Melveny & Myers LLP

(57) ABSTRACT

An apparatus for controlling operating features of a model train includes a plurality of selection devices, each of which corresponds to a respective operating feature of the train. The apparatus also includes a controller connected to the selection devices of the apparatus. The controller is operative to generate digital or DC offset messages corresponding to the selection devices. The apparatus further includes a transmitter connected to the controller. The transmitter is operative to send the digital or DC offset messages that are generated by the controller to a receiver located on the train in order to carry out the desired functions. This invention provides for at least a single button output of complex messages.

51 Claims, 2 Drawing Sheets

CONTROL FOR OPERATING FEATURES OF A MODEL VEHICLE

RELATED APPLICATIONS

This application claims the benefit of U.S. provisional application Ser. No. 60/394,550 filed Jul. 10, 2002, hereby incorporated by reference in its entirety.

BACKGROUND OF THE INVENTION

1. Field of the Invention

The present invention relates in general to the control of a model vehicle such as a model toy train and more particularly to a simple control box for advanced operating features of the same.

2. Description of the Related Art

Model train enthusiasts have always desired the ability to control a number of functions of one or more model trains on a track. Early trains had only a single feature, the motor of the train was "on" or it was "off." In the typical modern system, the train engine is an electrical engine receiving power from the train tracks. The train motor typically picks up the power from a voltage applied to the tracks through contacts on the bottom of the train or through train wheels. The amplitude and polarity of the voltage applied to the tracks controls the speed and direction of the train. In HO systems, this voltage is a direct current (DC) voltage. More commonly, particularly for O-gauge systems, this voltage is an alternating current (AC) voltage. In AC voltage systems, in order to change the direction of the train, the AC signal is removed and reapplied to the track.

One approach for controlling on-board functions of a train was to superimpose a DC voltage on top of such an AC track voltage applied to the track. The applied DC voltage forms a DC offset on the track (i.e., the AC track voltage is normally "balanced"). The DC offset is detected by a DC receiver mounted on the train, activating an onboard device, such as a whistle, or the like. Trains so equipped are responsive to track power changes and a single DC offset. A later improvement included applying DC offsets of different polarities and amplitudes, increasing the number of on-board functions that could be implemented. In the O-gauge market, model trains responsive to changes in track power (for control of the speed) and DC offsets (for control of the features or functions) are referred to as being controlled in a conventional mode.

U.S. Pat. Nos. 4,914,431, 5,184,048 and 5,394,068 issued to Severson et al. disclose a method of increasing the number of control signals available by the incorporation of a state machine in the train. Model trains responsive to this method may include a state machine whereby a plurality of key presses of a remote control device changes the state of the state machine and activates a feature of the train associated with that state. However, use of this system may require that the user learn a sequence of key presses.

More recently, so-called command control techniques have been applied to model trains. For example, U.S. Pat. Nos. 5,251,856, 5,441,223 and 5,749,547 to Young et al. disclose, among other things, providing a digital message which may include a command to a model train using various techniques. The digital message(s) so produced are typically read by a decoder mounted on the train, which then executes the decoded command. Operating such a system involves manipulating a remote control and some particularly advanced features may require programming.

Other systems have been introduced, but have been perceived as difficult to program by some users, particularly when model trains associated with different control systems are used on a common track. Because of the perception by certain users, many model toy trains with such internal electronics are run on layouts without the associated controls needed to actually activate those electronics. Instead, a transformer merely supplies power to the tracks and the model train is operated in conventional mode. Thus, in some circumstances, the advanced operating features of these modern model trains are not fully utilized.

Therefore, a need exists for a system that minimizes or eliminates one or more of the problems or challenges noted in the Background.

SUMMARY OF THE INVENTION

A simple control box for advanced train operating features is presented. An apparatus in accordance with the present invention includes a plurality of selection devices each of which correspond to a different operating feature of the train. An apparatus according to the present invention also includes a controller connected to the selection devices which is operative to generate command signals corresponding to the selection devices. An apparatus in accordance with the present invention further includes a transmitter connected to the controller that is operative for sending command signals to a receiver located on the train.

These and other features and objects of this invention will become apparent to one skilled in the art from the following detailed description and the accompanying drawings illustrating features of this invention by way of example.

DETAILED DESCRIPTION OF THE PREFERRED EMBODIMENTS

Figure 1:
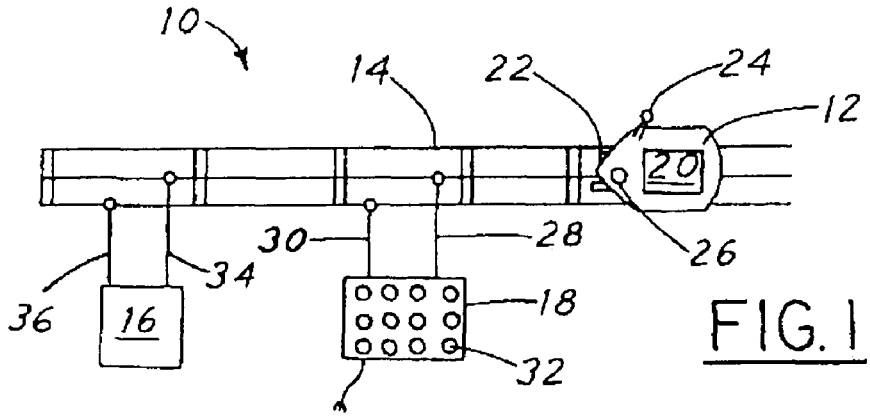
FIG. 1 is a plan view of a model toy train layout including a control box according to one embodiment of the present invention.

Referring now to the Figures wherein like reference numerals are used to identify like components in the various views, FIG. 1 is a top plan view illustrating a model toy train layout 10. Train layout 10 includes at least one model train 12, a track 14 upon which train 12 travels, a transformer 16, and a control box 18. Train 12 includes control electronics 20, which can be any electronics mounted upon a model train 12. For example, the control electronics 20 can include simple or advanced DC or AC motor control, depending upon the motor of the model train 12. Control electronics 20 may additionally include electronics that control various operating features of the train, such as lights 22, a horn 24 and/or a smoke stack 26, as shown in FIG. 1. One feature of the present invention is that it allows, in one embodiment, the user to obtain speed control via conventional throttle adjustments on a conventional variable output transformer, thus maintaining a familiar interface for speed control. In this regard, the control box 18 looks at the track voltage, infers a commanded speed and then sends out a command to the model train 12, while additionally allowing the user to activate various operating features through the inventive control box 18.

The assignee of the present invention provides command control products under its TRAINMASTER trademark consistent with U.S. Pat. Nos. 5,251,856, 5,441,223 and 5,749,547 to Young et al., each hereby incorporated by reference in its entirety. In a constructed embodiment, control box 18 is configured to control TRAINMASTER-equipped model trains (i.e., consistent with U.S. Pat. Nos. 5,251,856, 5,441,223 and 5,749,547). In an alternate embodiment, control box 18 is implemented with an alternate protocol for controlling model trains equipped with such alternate protocol, for example only, including the protocol described in U.S. Pat. Nos. 4,914,431, 5,184,048 and 5,394,068 to Severson et al., each of which is hereby incorporated by reference in its entirety. In still another embodiment, control box 18 is configured to control model trains compliant with multiple, different model train operating protocols. For example, control box 18 may be configured, in such other embodiment, to control model trains compliant with TRAINMASTER command control, and to control model trains compliant with the protocol(s) described in the U.S. patents issued to Severson et. al. noted above. The particular protocol used may, for example only, be made selectable on control box 18.

It should be understood that model train 12 and control box 18 must operate in accordance with the same protocol. For example only, in a constructed embodiment, control box 18 is configured with the TRAINMASTER protocol. Upon powering up, control box 18 generates a signature signal that indicates the presence of a TRAINMASTER compliant control attached to the layout 10. A TRAINMASTER-equipped model train is configured to detect this signature signal and automatically configure (or reconfigure) itself for TRAINMASTER command control operation. Through this mechanism, both control box 18 and model train 12 are operating in accordance with the same protocol. Of course, other configuration approaches are possible to configure the control box 18 and the model train (or trains) to operate under the same protocol (e.g., hard switches on the model train).

With continued reference to FIG. 1, for a single train operating on a single block of track, a two-wire hookup, labeled as connectors 28 and 30, is used between the control box 18 and the tracks 14, for supplying control signals to the tracks 14 originating from the control box 18. In the embodiment shown in FIG. 4, control box 18 may be configured to control model trains operating on a plurality of blocks, for example, two blocks; or for two trains operating on a single block of track. For such a two block arrangement, a second two-wire connector hookup is provided to connect control box 18 to the second block of track 14, wherein like connections are made to the second block as in the first block. For the arrangement where two trains are operating on a single block of track 14, two transformers are used, wherein a first transformer provides input to one of the trains and power to both of the trains, and a second transformer provides input to the other train, but does not provide power to either train.

With reference to FIG. 1, transformer 16 supplies power to track 14 through connectors 34, 36, while control box 18 is powered by conventional wall outlet. Transformer 16 can be a conventional AC or DC transformer, depending on the requirements of the layout, and in particular, the model train 12. Additionally, transformer 16 may provide either a fixed output or a variable output. The type of transformer used will depend on the embodiment of control box 18 being used. For the first embodiment of control box 18 shown in FIG. 2, a variable-output transformer 16 is provided such that conventional control of the speed and direction of model train 12 may be retained, yet allowing the user a simplified access to the operating features of model train 12 controlled through an advanced, command control protocol, such as TRAINMASTER for example only. For the second embodiment shown in FIG. 3, however, a fixed output transformer 16 may be used, inasmuch as the embodiment of FIG. 3 allows for the control of the voltage actually applied to the track. In a fixed output transformer arrangement, the voltage level may be controlled by the use of a button, potentiometer, remote control, or the like. Alternately, for the embodiment of FIG. 3, a variable output transformer 16 may be used wherein the user adjusts the output to a high or maximum level so as to functionally equip it as fixed output transformer. In a constructed embodiment, the layout is an O-gauge layout and the transformer is an AC transformer.

In operation, transformer 16 transforms typical AC line voltage (e.g., 120 VAC) to a reduced level (e.g., 0-18 VAC for a conventional O-gauge variable output model train transformer) and supplies the same to track 14.

A plurality of pushbuttons 32, for example twelve (12) as shown, are mounted in the casing of the control box 18. It is evident that the number of pushbuttons 32 shown, are by example only. Thus, more or less than twelve operating features can be labeled on the control box 18 and operated by the pushbuttons 32. Each pushbutton 32 can be labeled with an advanced feature available to the user, depending upon the capability of the particular train 12 or trains being operated. The pushbutton activated operating features may include, but are not limited to, "horn," "bell," "brake," "boost," "front coil coupler," "rear coil coupler," "advanced voice features," "smoke control," etc. It will also be evident from the discussion herein that pushbuttons 32 are not necessary. Control box 18 can instead incorporate any means of switching between at least two states, including, but not limited to, toggle switches or contact pads or the like. Control box 18 receives input information entered by the user through pushbuttons 32. Control box 18 then determines the nature of the desired action and formats a command configured to effect the desired action in accordance with the protocol in effect (or selected for operation of control box 18). Control box 18 is then configured to generate suitable signals and supply such signals through the connectors 28, 30 provided to the track 14. The supplied signal is thus configured to operate the corresponding operating feature of the train 12 as indicated by the selected pushbutton 32. The control electronics 20 of the train 12 are configured to receive the supplied signals and respond to such signals by activating the operating feature the user selects from the plurality of available operating features as indicated by the pushbuttons 32.

Figure 2:
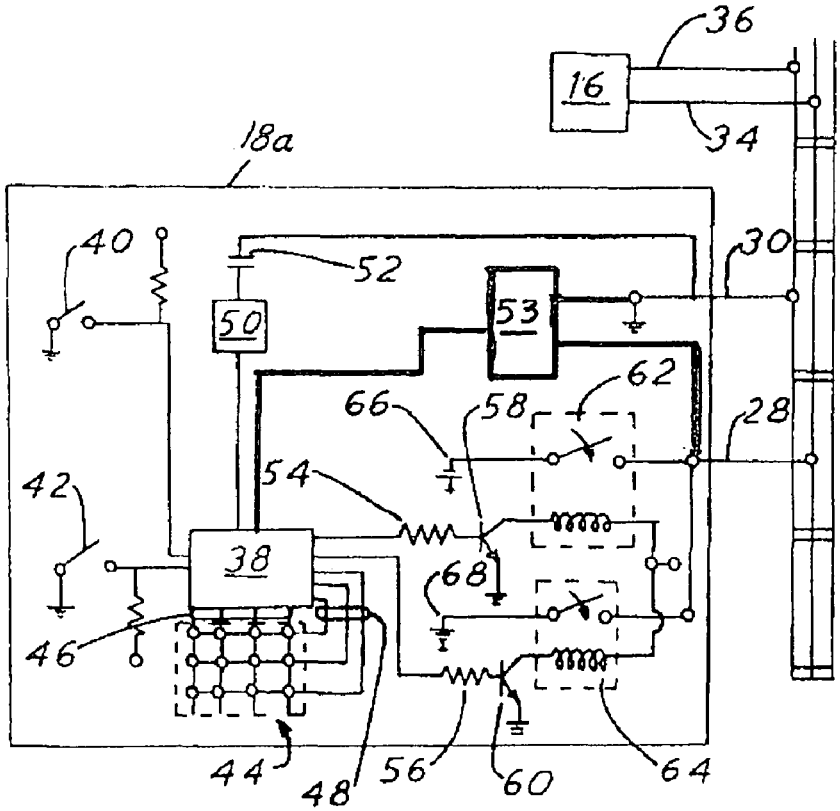
FIG. 2 is a schematic diagram of the components of the control box according to FIG. 1.

FIG. 2 shows a schematic diagram of a first preferred embodiment of the control box of FIG. 1, designated control box **18*a*, which is suitable for use with a typical three rail O-gauge AC-powered layout. As can be seen, connector 30, connected between control box 18*a* and the outside rail of track 14, is grounded. Similarly, connector 36, which is the ground or common terminal of transformer 16, is also connected to the outside rail of track 14. In another embodiment, instead of connecting connector 30 directly to track 14, it can be connected to the ground terminal on transformer 16. Connector 28 extends from control box 18*a* to the center rail of track 14, and connects the circuitry of control box 18***a*, which generates the control signals used by control electronics 20 to enable certain advanced operating features, to track 14. In another embodiment, instead of being connected directly to track 14, connector 28 can be connected to the power terminal on transformer 16.

Control box 18*a*, in the illustrative embodiment, includes a controller 38. Controller 38 may comprise a conventional microcontroller or a microprocessor unit (MPU) with associated memory and an input/output interface. In this embodiment, controller 38 is suitably configured through software to perform the functions described herein. Of course, the functions herein described with respect to controller 38 can be performed in whole or in part by equivalent analog and/or digital circuitry. Controller 38, in response to inputs provided by pushbuttons 32 sends signals to track 14 signaling the control electronics 20 of a train 12 to operate certain advanced operating features of train 12. The process of determining the desired action or desired operating feature to be activated on model train 12, the preparation of an appropriate digital message to effect the desired action or operating feature, the transmission of the digital message to the receiver in the model train, and the configuration of the model train to receive the digital message, may all be as set forth in U.S. Pat. Nos. 5,251,856, 5,441,223 and 5,749,547 hereby incorporated by reference for at least such purpose. Of course, other approaches, as mentioned above, are possible and still remain within the spirit and scope of the present invention.

The embodiment shown in FIG. 2 includes optional protocol selection mechanism for allowing a user to select the protocol(s) for operation. As described above, in a constructed embodiment, control box 18*a* is configured for one command control protocol (e.g., TRAINMASTER command control). In the illustrated embodiment, however, a first switch 40 and a second switch 42 are provided for the purpose of selecting one or more of a plurality of protocols. As previously discussed, many methods of controlling model trains have been proposed and implemented. In the embodiment of FIG. 2, the two forms for the control signals may correspond to a protocol described in the patents to Severson et al., identified above for actuation by conventional signaling (e.g., DC offsets), and a command control mode (e.g., LIONEL TRAINMASTER command control system). While these two modes have been discussed above, they are meant to be exemplary only and not limiting in nature. One of ordinary skill in the art will appreciate that other control approaches exist, that are within the spirit and scope of the present invention. In each of these methods, the train being controlled responds to signals sent in different forms. In the protocol according to the patents issued to Severson et al. using conventional signaling methods, the signals sent to a train 12 comprise a plurality of positive and negative DC offsets superimposed on the AC track voltage, with short interruptions in AC power changing the state of the motor. These DC offset signals are supplied to an on-board state generator that is part of the control electronics 20, which activates a train operating feature depending upon both the state and the order of positive and negative signals superimposed on the track voltage. The command control method, such as the TRAINMASTER command control system protocol, describes the use of digital messages independent of the level of track power. The digital messages are addressed and transmitted on the track, and are received and by the addressed engines. The digital message is transmitted using the track 14. This method preferably does this with a frequency shift key (FSK) modulation technique. Each train, such as train 12, has a receiver unit that looks for its unique address, receives the data corresponding to its address and then uses the data to control operation of train 12 and its advanced operating features. The receiver unit is thus part of the control electronics 20 of the train 12. The foregoing is exemplary and not limiting in nature.

With continued reference to FIG. 2, when the first switch 40 is closed, control box 18 transmits signals to track 14, and therefore, control electronics 20 in one form. When second switch 42 is closed, control box 18*a* transmits signals to track 14, and therefore, control electronics 20 in a second form. When both switches 40, 42 are closed, control box 18*a* transmits signals to track 14 destined for control electronics 20 in both forms. For the embodiment shown, control box 18*a* receives power by plugging box 18*a* into a conventional wall outlet. Then, the controller 38 adds a signal conforming to the command control method when switch 40 is closed. Alternately, or in addition to this signal, the controller 38 controls the DC offsets applied to track 14 for control electronics 20 receiving signals when switch 42 is closed. Of course, more than two forms for the signals are possible through the inclusion of additional switches or selection means (e.g., a software controlled interface). Switches 40, 42 as shown are manual switches, such as slide switches, associated with control box 18*a* and located on the casing of control box 18, which the user can set. However, it should be noted that the use of switches to carry out this functionality is illustrative only and not meant to be limiting in nature. Other selection means exist that remain within the spirit and scope of this invention.

In operation, the controller 38 continuously monitors whether a pushbutton 32 of control box 18*a* has been depressed by the user, indicating the user's desire to activate the operating feature indicated by the corresponding label on the pushbutton so depressed. In the embodiment depicted in FIG. 2, the electrical connections of the pushbuttons 32 are represented by the grid 44. Grid 44 comprises a plurality of column selects 46 and row selects 48. Preferably, controller 38 continuously scans grid 44 by sequentially scanning one column and row by respectively selecting one column select 46 and row select 48 and looking for closures indicating a key press. The keypress is recorded. A first lookup may be performed by controller 38 so as to determine what desired action or operating feature has been selected by the user based on row/column. A second lookup may be performed by controller 38 in order to determine what digital messages, or other signaling is required in order to effect the desired action or operating feature. The controller 38 may then transmit the signals in a form appropriate to the selected protocol(s). It should be noted, however, that this grid methodology is exemplary only and not limiting in nature. Other methods exits, such as using separate inputs into controller 38 for each operating feature that remain within the spirit and scope of the invention.

In this regard, when switch 40 is closed (e.g., command control mode), controller 38 sends an appropriate data stream, based upon the pushbutton 32 pressed, to a transmitter 50. Transmitter 50 is coupled (e.g., for example only, through a coupling capacitor 52) to tracks 14. Transmitter 50 places the requested data stream on track 14 using the selected form or protocol (e.g., command control protocol). Thus, any train 12 on track 14 with control electronics 20 able to process these commands will appropriately respond to the command.

Conventional Speed control simulator. Many model trains, when operating in a command control mode (eg. TRAINMASTER control mode) do not respond to conventional variations of track voltage for purposes of varying speed of the model train, but rather are configured to respond to digital messages containing a desired speed command. However, the users are most familiar with the tactile, conventional approach for speed control, namely mechanically varying a potentiometer or the like on a transformer for varying the speed. The present invention reconciles these considerations by providing a speed control feature to be described below. An additional feature of control box 18*a* operating in the command control mode relates to obtaining and then sending speed commands to train 12. To control the speed of train 12, control box 18*a* must format and transmit a speed control message to train 12. In this regard, control box 18*a* includes a voltage sensor 53 which allows controller 38 to sample the voltage applied to track 14 by transformer 16, which is external to control box 18*a*. Accordingly, through connectors 28 and 30, controller 38 continuously monitors and reads the voltage supplied to track 14. Controller 38 is configured to infer, based on the level of the track voltage, what speed the user wishes the model train to travel. Based on the sampled voltage, controller 38 prepares a speed command message which controller 38 then sends to the control electronics 20 of train 12. Depending on the varied voltage on track 14, as monitored by controller 38 via voltage sensor 100, control electronics 20 then either increase, decrease, or maintain the speed of train 12. Thus, while train 12 does not respond to voltage variations applied to track 14 directly in terms of changing its speed, it does respond to digital speed control messages from control box 18*a*. Rather, train 12 relies on control box 18*a* to monitor these variations, and then command control electronics 20 to change the speed accordingly.

By way of example, assume that the layout 10 is an AC-powered, 3-rail, O-gauge layout and that transformer 16 is a conventional, variable output transformer 16 having an output ranging from 0 volts AC to 18 volts AC. Further assume that the control box 18*a* is configured so as to be compatible with a command control protocol (e.g., TRAIN-MASTER command control system) and that model train 12 is an engine that is compatible with such protocol.

Further assume that there is a minimum voltage needed to commence movement of train 12, say, for purposes of example only, 9 volts. Those of ordinary skill in the art will recognize that a model train 12 can be constructed to have a much lower movement threshold, perhaps as low as zero or near zero. However, the 9 volt level is level associated with commercially available model trains and will therefore be used without diminishing the generality and broad applicability of the present invention.

In this example, the protocol under which the control box 18*a* operates includes so-called absolute speed commands, such command taking the general form shown in equation (1):

$$\text{Engine [\#1 or \#2] Absolute Speed [0-31].} \quad (1)$$

Figure 4:
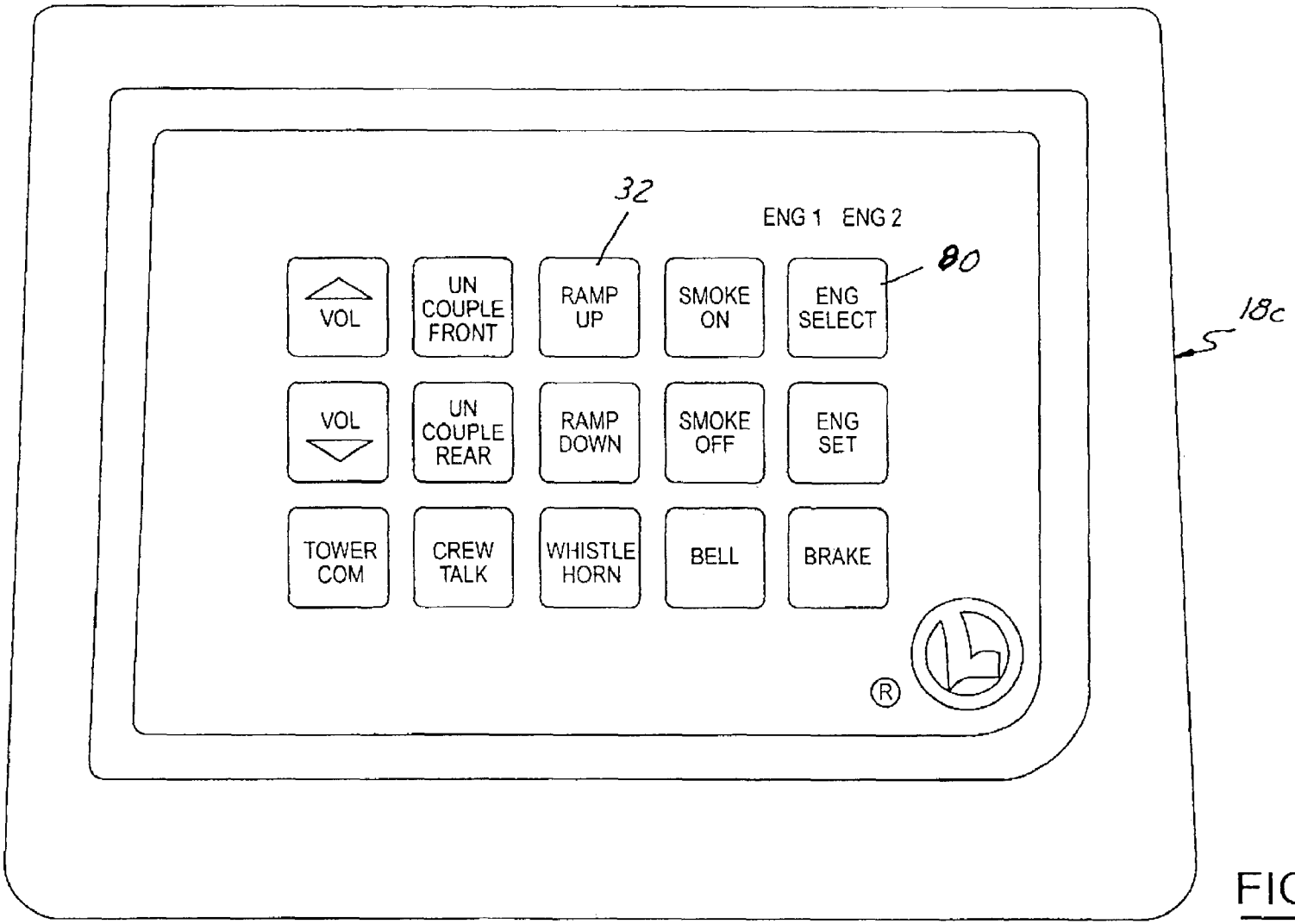
FIG. 4 is front face view of one embodiment of the control box in accordance with the present invention.

Control box 18*a* is configured to format a digital message to be transmitted to model train 12 in the form of equation (1). Equation (1) also provides for the selection of either a first model train 12 (i.e., engine #1) or a second model train 12 (i.e., engine #2) as the destination for the command. This is best shown in the embodiment of FIG. 4. The exemplary protocol also provides for thirty-two discrete steps to which an absolute speed for the model train 12 may be commanded. It should be understood that the foregoing is exemplary only and not limiting in nature.

Assume the user adjusts the variable output transformer 16 so that it outputs 12 volts. There are several approaches that control box 18*a* may employ in order to develop a suitable speed command, (1) linear step approach and (2) non-linear step approach.

Linear Steps. In this embodiment, any voltage applied to the track by the user's adjustment of the transformer, as read by the control box 18*a*, that is below the movement threshold is assigned a "zero" step or halt level. Any track voltage above the zero-movement threshold level is determined as follows:

$$((\text{Sampled Track Voltage}-\text{Zero-Movement Threshold})/(\text{Max Voltage}-\text{Zero-Movement Threshold}))*32(\text{steps}) \quad (2)$$

In the example, a sampled track voltage of 12 volts yields:

$$(12-9)/(18-9)*32=3/9*32 \textit{ approx. } 10.$$

In this example, the, using a linear step approach (i.e., evenly spaced increases in track voltage for incrementing the step level in the speed command), an absolute speed command parameter would be ten (10).

Non-Linear Steps. This approach is similar to the above linear step approach but does not require evenly-spaced steps for incrementing the speed command parameter. For example, it is often desirable to require larger increases in the voltage on the track before incrementing to the next step level. This is to provide, for example, greater sensitivity on the low end of the voltage scale, where end-users typically wish greater control (e.g., to observe the operation of the model train 12, to perform a delicate operation, or the like). In all other respects, the non-linear approach would be similar to the linear approach. This is not limited to but could be implemented by translating or looking up the difference in voltage above the zero point and translating it to a given speed step.

Execution of the Speed Command in the Model Train. Once the speed command is received by the model train, it must be executed by the control electronics 20. Under an open loop approach, the control electronics 20 would apply the prevailing track voltage in accordance with the commanded speed step level (e.g., the 12 volts would be applied at a duty cycle of $10/32$). Of course, other electric control methodologies may be employed and remain within the spirit and scope of the present invention. Under a closed loop approach, the speed command may be translated into a motor speed (not model train speed) parameter, and using a sensor or the like associated with the motor, the voltage on the track can be adjusted using known methods in order to maintain the desired motor speed parameter. In this example, the speed command of ten (10) calculated above under either the linear or nonlinear approach may translate to X revolutions per minutes. Control electronics 20 would then apply the needed voltage from the track in order to meet and maintain the X rpms of the motor. Through the foregoing, the invention enables the user to continue to adjust the variable output transformer in a conventional manner, although the actual control of the speed of the model train 12 is controlled by control box 18*a*. Maintaining transparency to the user is a particularly important feature of the present invention Through the foregoing, the present invention maintains, for the benefit of the user, a familiar conventional interface for speed control while in reality implementing a command control based speed control system through box 18.

In the constructed embodiment, the digital speed control messages prepared by controller 38 and sent by control box 18*a* to train 12, which are referred to above, are in the nature of absolute speed messages, as opposed to relative speed messages. One advantage of the present invention is that a que technique is used wherein the absolute speed message sent to the train is repeated in order to increase the reliability of the system. Additionally, equal priority is given to each speed message sent, be it to one train or two, so that one message is not dominating the communication path.

When the switch 42 is closed (e.g., conventional signaling mode), signals according to the DC offset method are enabled. When the controller 38 detects the operation of a pushbutton 32, controller 38 provides a modulated DC offset signal to track 14 through the connector 28. This modulated DC offset signal is a signal conforming to the DC offset method for the command indicated by the pushbutton 32 pressed. Thus, signals start when controller 38 applies a positive logic signal to one of resistors 54 and 56. When a positive logic signal is applied to one of the resistors 54, 56, a transistor 58, 60 is respectively turned on. That is, current flows through the transistor 58 or 60. As seen in FIG. 2, each resistor 54, 56 is respectively connected to the base of a transistor 58, 60, while the emitter of each transistor 58, 60 is grounded. The collector of each transistor 58, 60 is respectively connected to a relay 62, 64. The relays are not shown in detail, but are contemplated herein as being electromechanical relays. However, it should be noted that the relays in this embodiment are used for illustrative purposes only and are not meant to be limiting in nature. In other embodiments devices such as solid state devices may be used instead of relays.

A negative DC offset supply 66 is associated with relay 62 such that the closing of the switch in relay 62 generates a negative DC offset applied to track 14 through connector 28. Similarly, a positive DC offset supply 68 is associated with relay 64 such that the closing of the switch of relay 64 applies a positive DC offset to track 14 through the connector 28. A command conforming to the DC offset method is sent by controller 38 by varying the distance and spacing of the DC offsets from the DC offset supplies 66 and 68. Of course, this logic can be done in many different ways known to those skilled in the electronics discipline. For example, transistors, thyristors, etc., may replace the relays. A train 12 riding on track 14 with control electronics 20 operable to receive signals conforming to the DC offset method will appropriately respond to the command.

Figure 3:
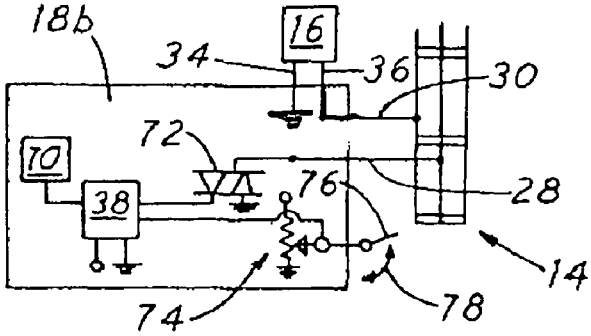
FIG. 3 is a partial schematic diagram of an alternate embodiment of the control box according to the present invention.

An alternate embodiment of the control box of FIG. 1 is shown in FIG. 3, and is designated control box 18*b*. Other than as described below, the control box 18*b* is the same as control box 18*a*. Accordingly, a repeat description will not be made. FIG. 3 shows the incoming power re-controlled by using a set of power devices and a separate throttle control on the control box 18*b*. In this view, the switches 40, 42, grid 44, column selects 46 and row selects 48 are omitted. As mentioned above, this grid method is meant to be exemplary and not limiting in nature. For simplicity the transmitter 50, coupling capacitor 52, and voltage sensor 53 are also omitted.

As eluded to above, the preferred mode of operation in this embodiment is to turn the transformer to a maximum value to allow for the greatest range in adjusting the power level provided to the track 14. In control box 18*b*, connector 36 from transformer 16 is grounded at control box 18*b* while connector 34 from transformer 16 to control box 18*b* is coupled to connector 28 between the control box 18*b* and track 14. The connection formed by connectors 28 and 34 provides either a DC or an AC voltage to track 14. Controller 38 receives as its input the inputs from grid 44 and a 60-Hz reference from the circuit 70. The circuit 70 can be, for example, a zero crossing detector detecting a 60-Hz reference as a zero crossing point of the supply from transformer 16 to track 14 flowing along the connection formed by connectors 28 and 34. Such zero crossing detectors are well known in the art and thus are not illustrated. The 60-Hz reference supplied by the circuit 70 is used by controller 38 in control of a triac 72, in order to supply an average power and DC offsets.

To use triac 72 for this purpose, controller 38 also receives an input from a potentiometer 74. The setting of potentiometer 74 is responsive to the movement of a lever 76 in the direction indicated by arrow 78. In response to changes of the impedance of potentiometer 74, controller 38 calculates a phase conduction angle for the supply through triac 72. The phase conduction angle is the total angle over which the flow of current to track 14 through triac 72 and connector 28 occurs, delivering an average power from transformer 16. By means of triac 72, and according to known methods, a DC offset can also be controlled and varied to supply a signal in accordance with the DC offset method to track 14. Thus, relays are unnecessary in this embodiment, as are the DC offset supplies 66 and 68. While in this illustrated embodiment a potentiometer 74 is used, it should be noted that other means exist, such as buttons, keys or remote control, to carry the same functionality. Of course, triac 72 could instead be another control device. For example, a MOSFET can control power from a DC power source 16, whereas the configuration of FIG. 3 is directed to an AC transformer 16.

FIG. 4 shows a front face view of a still further embodiment of the control box of FIG. 1, designated control box 18*c*. It should be noted that control box in accordance with the present invention can also be utilized to control the advanced operating features on trains operating on two or more different blocks of track or two trains on one track. Control box 18*c* is an embodiment suitable for use in controlling two blocks of layout 10. Multiple control boxes, for example, control boxes 18*c*, may be employed to control further blocks (in excess of two) included in layout 10. To carry out this functionality, control box 18*c* includes a selection device 80 that allows the user to switch between the two model trains. Altering the throttle of a particular train will also cause control box 18 to automatically switch to that train. Each model train operating in the layout has a distinct address. Depending on which train is selected, either automatically or manually, as the pushbuttons 32 are depressed the control box 18 sends control signals to the address associated with the selected train that can only be read by that particular train to actuate its advanced operating features.

It should be noted that the above embodiments are exemplary only and not limiting in nature. Those skilled in the art will appreciate that in light of the foregoing disclosure, other embodiments and configurations exist that remain within the spirit and scope of this invention.

The invention claimed is:

1. An apparatus for controlling operating features of a model train compliant with at least one of plural command protocols, comprising:

a switch permitting selection of one of said plural command protocols;

a plurality of selection devices each corresponding to a respective operating feature of said train;

a controller connected to said selection devices and said switch, said controller being operative to generate train command messages corresponding to said selection devices and formatted in accordance with a selected one of said plural command protocols; and a transmitter connected to said controller operative to send said train command messages to a receiver located on said train.

2. An apparatus in accordance with claim 1, wherein said plurality of selection devices include pushbuttons.

3. An apparatus in accordance with claim 1, wherein said transmitter is operative to send said train command messages using a frequency shift key modulation method.

4. An apparatus in accordance with claim 1, wherein said transmitter is operatively connected between said controller and said track, and further wherein said transmitter transmits said train command messages to said track.

5. An apparatus in accordance with claim 4, further comprising a capacitor operatively connected between said transmitter and said track.

6. An apparatus in accordance with claim 1, wherein said train command messages further comprise digital signals.

7. An apparatus in accordance with claim 1, wherein said controller is operative to monitor voltage being applied to said track by way of a voltage sensor, and to then generate and transmit corresponding speed command signals to said receiver on said train.

8. An apparatus in accordance with claim 7 wherein said controller is operative to repeat said speed command signals to said receiver by using a que technique.

9. An apparatus in accordance with claim 1, wherein said controller is operative to generate and apply conventional DC Offsets to said track.

10. An apparatus in accordance with claim 9, further comprising:

a first resistor connected to said controller, and a first transistor connected between said first resistor and a first switching device; and a second resistor connected to said controller, and a second transistor connected between said second resistor and a second switching device;

wherein said first switching device, when actuated, connects a negative DC offset supply to said tracks, and wherein said second switching device, when actuated, connects a positive DC offset supply to said tracks.

11. An apparatus in accordance with claim 10 wherein said switching devices include electromechanical relays.

12. An apparatus in accordance with claim 10 wherein said switching devices include solid state devices.

13. An apparatus in accordance with claim 1 further comprising a switching means for selecting between one of two of said trains that are operating on the same block of said track or between a first and second train operating on separate blocks.

14. An apparatus in accordance with claim 13 wherein said switching means includes a pushbutton.

15. An apparatus in accordance with claim 13 wherein said switching means is operative to actuate automatically to one of said trains whose speed is altered.

16. An apparatus for controlling operating features of a model train compliant with at least one of plural command protocols, comprising:

a switch permitting selection of one of said plural command protocols;

a plurality of selection devices each corresponding to a different operating feature of said train;

a controller operatively connected to said selection devices and said switch, said controller being operative to generate DC offset signals corresponding to said selection devices in accordance with one of said plural command protocols wherein said signals are delivered to a track upon which said train is operating.

17. An apparatus in accordance with claim 16, wherein said plurality of selection devices include push buttons.

18. An apparatus in accordance with claim 16 further comprising:

a first resistor connected to said controller, and a first transistor connected between said first resistor and a first switching device; and a second resistor connected to said controller, and a second transistor connected between said second resistor and a second switching device, wherein said first switching device, when actuated, connects a negative DC offset supply to said tracks, and wherein said second switching device, when actuated, connects a positive DC offset supply to said tracks.

19. An apparatus in accordance with claim 18 wherein said switching devices include electromechanical relays.

20. An apparatus in accordance with claim 18 wherein said switching devices include solid state devices.

21. An apparatus in accordance with claim 16, wherein said controller is operative to monitor voltage being applied to said track by way of a voltage sensor, and to then generate and transmit corresponding speed command signals to said receiver on said train.

22. An apparatus in accordance with claim 21 wherein said controller is operative to repeat said speed command signals to said receiver by using a que technique.

23. An apparatus in accordance with claim 16, wherein said controller is operative to generate command messages corresponding to said selection devices in accordance with another one of said plural command protocols wherein said command messages are delivered to a track upon which said train is operating.

24. An apparatus in accordance with claim 16, wherein said controller is operative to generate digital messages corresponding to said selection devices in accordance with another one of said plural command protocols, and wherein said apparatus further comprises a transmitter to send said digital messages to a receiver located on said train.

25. An apparatus in accordance with claim 24, wherein said controller is operative to create said digital messages using a frequency shift key modulation method.

26. An apparatus in accordance with claim 24, wherein said transmitter is operatively connected between said controller and said track, and further wherein said transmitter transmits said command signals to said track.

27. An apparatus in accordance with claim 24, further comprising a capacitor operatively connected between said transmitter and said track.

28. An apparatus in accordance with claim 16 further comprising switching means for selecting between one of at least two of said trains that are operating on the same block of said track or between a first and second train operating on separate blocks.

29. An apparatus in accordance with claim 28 wherein said switching means includes a pushbutton.

30. An apparatus in accordance with claim 28 wherein said switching means is operative to actuate automatically to one of said trains whose speed is altered.

31. A method of controlling operating features of a model train compliant with at least one of plural command protocols, comprising the steps of:

receiving a user selection of one of said plural command protocols;

receiving a user selection of a desired operating feature on said train to be controlled;

producing a train command signal corresponding to said selected operating feature and having a form in accordance with the selected one of said plural command protocols; and delivering said train command signal from said controller to said train.

32. A method of controlling operating features of a model train in accordance with claim 31 further including detecting voltage of a track on which said model train is operating.

33. A method of controlling operating features of a model train in accordance with claim 31, wherein said producing a train command signal includes generating a digital message.

34. A method of controlling operating features of a model train in accordance with claim 31, wherein said delivering further comprises transmitting said train command signal to a track on which said train is operating.

35. A method of controlling operating features of a model train in accordance with claim 31, wherein said delivering further comprises transmitting said train command signal to said train via an RF medium.

36. A method of controlling operating features of a model train in accordance with claim 31, wherein said producing a train command signal includes generating a DC offset signal.

37. A method of controlling operating features of a model train in accordance with claim 36 wherein said delivering further comprises transmitting said DC offset signal to a track on which said train is operating.

38. An apparatus for controlling a model train operating on a track, comprising:

a transformer operatively coupled to the track and applying a voltage thereto, the transformer being manually variable to selectively alter a level of the applied voltage; and a controller operatively connected to the track, the controller including a voltage sensor operative to measure the level of the applied voltage, the controller being operative to generate a train command message corresponding to the measured voltage level, the controller further including a transmitter operative to send the train command messages to a receiver located on the train;

wherein the model train is compliant with at least one of plural command protocols, the controller further comprising a switch input permitting user selection of one of the plural command protocols.

39. The apparatus of claim 38, wherein the controller further comprises a plurality of selection devices each corresponding to a respective operating feature of the model train.

40. The apparatus of claim 39, wherein the plurality of selection devices include pushbuttons.

41. The apparatus of claim 38, wherein said transmitter is operatively connected to the track and transmits the train command messages to the receiver via the track.

42. An apparatus for controlling operating features of a model train compliant with at least one of plural command protocols, comprising:

a user interface including a switch permitting selection of one of the plural command protocols and at least one selection device corresponding to a respective operating feature of said train;

a controller connected to said user interface and being operative to generate a train command message responsive to actuation of the at least one selection device and formatted in accordance with a selected one of said plural command protocols; and a transmitter connected to said controller operative to send the train command message to a receiver located on the train for execution of the corresponding operating feature.

43. The apparatus of claim 42, wherein the at least one selection device comprises at least one pushbutton.

44. The apparatus of claim 42, wherein the transmitter is further operative to send the train command message using frequency shift key modulation.

45. The apparatus of claim 42, wherein the transmitter is operatively connected to a track on which the model train operates, the transmitter sending the train command messages to the track.

46. The apparatus of claim 42, wherein the train command messages further comprise digital signals.

47. The apparatus of claim 42, wherein the controller further comprises a voltage sensor operatively coupled to a track on which the model train operates, the voltage sensor monitoring a voltage level applied to the track, the train command message generated by the controller thereby defining a desired speed of the train.

48. The apparatus of claim 42, wherein said controller is operative to generate and apply a DC offset voltage to a track on which the model train operates.

49. The apparatus of claim 42, wherein the user interface further comprises at least one additional switch permitting selection between one of two model trains operating on a common block of track or between a first and a second model train operating on separate blocks of track.

50. The apparatus of claim 49, wherein the at least one additional switch is operative to actuate automatically to select one of the trains having altered speed.

51. The apparatus of claim 42, wherein the operating feature of the train includes at least one of horn, bell, brake, boost, front coil coupler, rear coil coupler, voice, and smoke.

* * * * *